US006765548B1

(12) United States Patent
Doyen et al.

(10) Patent No.: US 6,765,548 B1
(45) Date of Patent: Jul. 20, 2004

(54) VIDEO CODING METHOD FOR A PLASMA DISPLAY PANEL

(75) Inventors: Didier Doyen, La Bouexière (FR); Carlos Correa, Schwenningen (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 328 days.

(21) Appl. No.: 10/088,886

(22) PCT Filed: Sep. 11, 2000

(86) PCT No.: PCT/FR00/02498

§ 371 (c)(1),
(2), (4) Date: Mar. 22, 2002

(87) PCT Pub. No.: WO01/22396

PCT Pub. Date: Mar. 29, 2001

(30) Foreign Application Priority Data

Sep. 23, 1999 (FR) ..... 99 11900

(51) Int. Cl.[7] ..... G09G 3/28
(52) U.S. Cl. ..... 345/60; 315/169.4; 345/690
(58) Field of Search ..... 345/60–63, 66, 345/68, 74.1, 76; 315/167–168, 169.1, 169.4; 313/484, 491, 514, 517, 520

(56) References Cited

U.S. PATENT DOCUMENTS 5,475,448 A * 12/1995 Saegusa ..... 348/797
5,999,154 A * 12/1999 Yoshioka ..... 345/89
6,201,519 B1 * 3/2001 Chevet et al. ..... 345/63
6,717,558 B1 * 4/2004 Weitbruch et al. ..... 345/63

FOREIGN PATENT DOCUMENTS

EP 874 349 A1 10/1998 ..... G09G/3/28
EP 945 846 A1 9/1999 ..... G09G/3/28

* cited by examiner

*Primary Examiner*—Bipin Shalwala
*Assistant Examiner*—Mansour M. Said
(74) *Attorney, Agent, or Firm*—Joseph S. Tripoli; Harvey D. Fried; Sammy S. Henig

(57) ABSTRACT

The invention proposes a novel technique for coding video for a plasma display panel, which aims to improve the use of rotating code. The method forming the subject of the invention carries out a coding of the highest grey level V1 over the entirety of the subscans while favouring the subscans whose illumination time is the lowest. The coding of the lowest grey level V2 is achieved using the common value COMMAX which results from the coding of the value V1 if the specific value SPEMAX is greater than the difference D of the grey levels. If SPEMAX is greater than the difference D, then the coding of the common value COMMIN corresponds to the lowest value V2.

9 Claims, 4 Drawing Sheets

VIDEO CODING METHOD FOR A PLASMA DISPLAY PANEL

This application claims the benefit under 35 U.S.C. §365 of International Application PCT/FR00/02498, filed Sep. 11, 2000, which claims the benefit of French Patent Application No. 99/11900, filed Sep. 23, 1999.

The invention relates to a method of coding video for a plasma display panel. More particularly, the invention relates to the coding of the grey levels of a type of panel with separate addressing and sustaining.

Plasma display panels, called hereafter PDPs, are flat-type display screens. There are two large families of PDPs, namely PDPs whose operation is of the DC type and those whose operation is of the AC type. In general, PDPs comprise two insulating tiles (or substrates), each carrying one or more arrays of electrodes and defining between them a space filled with gas. The tiles are joined together so as to define intersections between the electrodes of the said arrays. Each electrode intersection defines an elementary cell to which a gas space corresponds, which gas space is partially bounded by barriers and in which an electrical discharge occurs when the cell is activated. The electrical discharge causes an emission of UV rays in the elementary cell. Phosphors (red, green or blue) deposited on the walls of the cell convert the UV rays into visible light.

In the case of AC-type PDPs, there are two types of cell architecture, one called a matrix architecture and the other called a coplanar architecture. Although these structures are different, the operation of an elementary cell is substantially the same. Each cell may be in the ignited or "on" state or in the extinguished or "off" state. A cell may be maintained in one of these states by sending a succession of pulses, called sustain pulses, throughout the duration over which it is desired to maintain this state. A cell is turned on, or addressed, by sending a larger pulse, usually called an address pulse. A cell is turned off, or erased, by nullifying the charges within the cell using a damped discharge. To obtain various grey levels, use is made of the eye's integration phenomenon by modulating the durations of the on and off states using subscans, or subframes, over the duration of display of an image.

In order to be able to achieve temporal ignition modulation of each elementary cell, two so-called "addressing modes" are mainly used. A first addressing mode, called "addressing while displaying", consists in addressing each row of cells while sustaining the other rows of cells, the addressing taking place row by row in a shifted manner. A second addressing mode, called "addressing and display separation", consists in addressing, sustaining and erasing all of the cells of the panel during three separate periods. For more details concerning these two addressing modes, a person skilled in the art may, for example, refer to U.S. Pat. Nos. 5,420,602 and 5,446,344.

Figure 1:
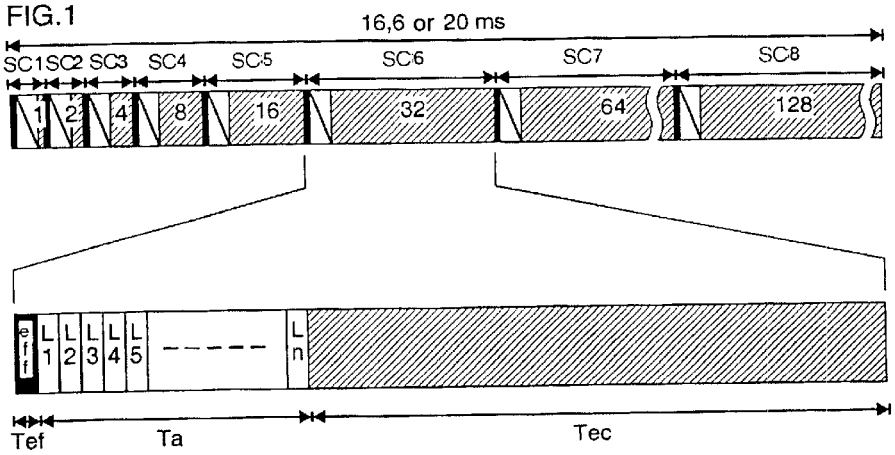

FIG. 1 shows the basic time division of the "addressing and display separation" mode for displaying an image. The total display time Ttot of the image is 16.6 or 20 ms, depending on the country. During the display time, eight subscans SC1 to SC8 are effected so as to allow 256 grey levels per cell, each subscan making it possible for an elementary cell to be "on" or "off" for an illumination time Tec which is a multiple of a value To. Hereafter, reference will be made to an illumination weight p, where p corresponds to an integer such that Tec=p*To. The total duration of a subscan comprises an erasure time Tef, an address time Ta and the illumination time Tec specific to each subscan. The address time Ta can also be decomposed into n times an elementary time Tae, which corresponds to the addressing of one row. Since the sum of the illumination times Tec needed for a maximum grey level is equal to the maximum illumination time Tmax, we have the following equation: Ttot=m*(Tef+n*Tae)+Tmax, in which m represents the number of subscans. FIG. 1 corresponds to a binary decomposition of the illumination time. This binary representation has numerous drawbacks. A problem of false contours (or "contouring") has been identified for quite some time.

The problem of false contours stems from the proximity of two areas whose grey levels are very close but whose illumination instants are decorrelated. The worst case corresponds to a transition between the levels 127 and 128. This is because the grey level 127 corresponds to an illumination for the first seven subscans SC1 to SC7, while the level 128 corresponds to the illumination of the eighth subscan SC8. Two areas of the screen placed one beside the other, having the levels 127 and 128, are never illuminated at the same time. When the image is static and the observer's eyes do not move over the screen, temporal integration takes place relatively well (if any flicker effect is ignored) and two areas with relatively close grey levels are seen. On the other hand, when the two areas move over the screen (and/or the observer's eye moves), the integration time slot changes screen area and is shifted from one area to another for a certain number of cells. The shift in the eye's integration time slot from an area of level 127 to an area of level 128 has the effect of integrating so that the cells are off over the period of one frame, which results in the appearance of a dark contour of the area. Conversely, shifting the eye's integration time slot from an area of level 128 to an area of level 127 has the effect of integrating so that the cells are lit over the duration of one frame, which results in the appearance of a light contour of the area. This phenomenon is manifested, when working on pixels consisting of three elementary cells (red, green and blue), as false coloured contours.

The explained phenomenon occurs at all level transitions where the switched illumination weights are totally or almost totally different. Switchings of high weight are more annoying than switchings of low weight because of their magnitude. The resulting effect may be perceptible to a greater or lesser extent depending on the switched weights and on their positions. Thus, the contouring effect may also occur with levels that are quite far apart (for example 63–128), but it is less shocking for the eye as it then corresponds to a very visible level (or colour) transition.

Figure 2:
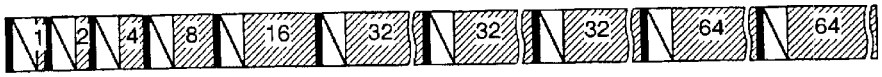

To remedy this problem of contouring, several solutions have been implemented. One solution consists in "breaking up" the high weights, this involving adding extra subscans. Only the total time of display of the image Ttot=m*(Tef+n*Tae)+Tmax remains fixed, thereby resulting in a drop in the time Tmax (since Tef and Tae are incompressible durations) and hence a drop in maximum brightness of the screen. It is possible to use up to 10 subscans while having correct brightness. With 10 subscans, the maximum illumination time Tmax is, currently, 30% of the total time whereas the erasure and address time is of the order of 70%. FIG. 2 represents an example of addressing using 10 subscans SC1 to SC10 in which the high weights are broken up into two.

Figure 3:
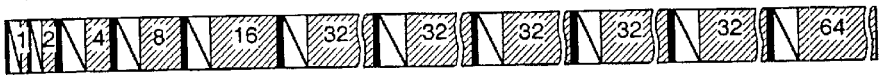

In order to reduce the considerable transitions and to increase the number of subscans without reducing the brightness of the screen, one technique consists in simultaneously scanning two successive rows for certain illumination values. We then have the following equation $Ttot=m_1*(Tef+n*Tae)+m_2*(Tef+n/2*Tae)+Tmax$. The erasure time Tef being negligible relative to n*Tae, we have the equivalence $Ttot \cong (m_1+m_2/2)*(Tef+n*Tae)+Tmax$. These simultaneous subscans halve the address time, and thus make it possible to add extra subscans without reducing Tmax. FIG. 3 represents an example of addressing with 11 subscans S1 to S11. Subscans S1 and S2 corresponding to the lowest illumination times are carried out on two rows at the same time so as to obtain an overall address time for these two subscans which is equal to the address time of a single subscan. If subscans common to two successive rows are performed for the illumination weights 1, 2, 4 and 8, it is possible to obtain 12 subscans so as to eliminate the transitions of weight 64. The problem with this solution is however the loss of resolution due to the simultaneous scanning of two rows.

Figure 4:
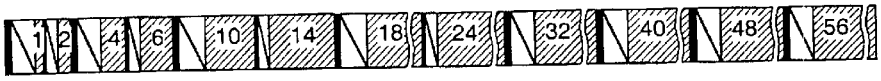

With regard to the principle of subscans scanning two rows at the same time, one solution consists in using a rotating-code coding, or multiple-representation coding. FIG. 4 illustrates a rotating-code coding using twelve subscans S1 to S12 with which are associated the following illumination weights: 1, 2, 4, 6, 10, 14, 18, 24, 32, 40, 48 and 56. One effect of the rotating code is to soften the high-weight switchings by reducing the number of weights switched when switching a high weight. To obtain the twelve subscans, a simultaneous scan of two rows is performed for the weights 2, 6, 14 and 24. Such a code furthermore allows a multiple representation of the numbers: 34=32+2=24+10=24+6+4=18+14 +2= . . . etc. This multiple representation of the numbers makes it possible to code the grey levels present on the two rows scanned at the same time in such a way that the weights 2, 6, 14 and 24 are identical. The person skilled in the art may refer to European Patent Application No. 0 874 349 for further details regarding this technique. Although the effect of softening the switching of a high weight is attenuated by the multiple coding, problems of loss of resolution and of contouring still arise when it is not possible to have suitable coding between two simultaneously addressed cells.

In European Patent Application EP-A-0 945 846, it is proposed, among other things, that the use of rotating codes be optimized so as to be able to increase the number of subscans considerably. The technique used consists in decomposing the grey levels GL1 and GL2, for two cells placed on two adjacent rows, into a common value CV and into a specific value SV1 and SV2. Thus, we have:

$$GL1=SV1+CV,$$

$$GL2=SV2+CV,$$

with, when GL1<GL2:

$$SV1=\alpha*GL1,$$

$$SV2=D+\alpha*GL1,$$

$$CV=\tfrac{1}{2}(GL1+GL2-SV1-SV2),$$

and where $\alpha$ is a coefficient to be defined as a function of the type of code used, D is equal to the difference GL2−GL1 after rounding, for example rounding to 5.

In most cases, the rounding to 5 of the difference makes it possible to limit the error to plus or minus 1 bit. However, such a system is limited by a deviation in the maximum difference value. It is then necessary to have for example SV1=0, SV2=maximum value, and CV chosen so as to minimize the error. The probability of frequency of occurrence of such a case depends essentially on the choice of the number of subscans specific to each cell and of the duration of illumination of the said subscans.

A second limitation of such a method of coding stems from the dispersion of the various codings for one and the same value. Specifically, the coding variations no longer depend on each cell but on each pair of cells independently of the neighbouring pair. The phenomenon of contouring is strongly attenuated inside the pair of cells but the attenuation of the false contour is less with the neighbouring pairs. The person skilled in the art will note, on reading EP-A-0 945 846, that to minimize this limitation, it is advisable to use a common part which is the largest possible, this having the effect of increasing the probability of error due to the limitation stemming from the deviation in the maximum value.

The invention proposes a novel scanning technique aimed at improving the use of rotating code. The grey level coding method forming the subject of the invention carries out a coding which favours one choice from among two possible codes as a function of the grey levels associated with each cell. The two codes use equivalent criteria so that the disparity between the two codes is minimized. According to the invention, the coding of the highest grey level over the entirety of the subscans has priority. If the coding over the entirety of the subscans is not advisable, the lowest grey level is coded over the subscans common to the two cells of the pair. In both cases, the subscans corresponding to the low illumination weight are favoured. Such a method carries out various codings for one and the same value while retaining great proximity between the various codes.

The subject of the invention is a method of displaying a video image on a plasma display panel for a duration of display, the said panel comprising a plurality of cells arranged in rows and columns, each cell being lit for a duration lying between zero and a maximum display time corresponding to the maximum brightness of a cell for a given brightness setting, the total time of illumination of a cell being divided into several illumination periods corresponding to various subscans among which are distinguished first subscans specific to an addressing of each cell and second subscans common to two cells arranged on neighbouring rows, such that, for a pair of cells sharing the same second subscans, the grey levels GL1 and GL2 of the said cells are decomposed into a common value CV and into a specific value SV1 and SV2 with the aid of the following equation: GL1=CV+SV1 and GL2=CV+SV2, with GL1 greater than or equal to GL2, the said method comprising the following steps:

E1: coding of the highest grey level GL1 over the entirety of the subscans while favouring the subscans whose illumination time is the smallest;

E2: extraction of the specific value VS1 corresponding to the coding of step E1;

E3: coding of the lowest grey level by using the common value CV resulting from step E1 if the specific value SVl extracted in step E2 is greater than the difference GL1−GL2.

In certain cases, the following step is carried out:

E4: coding of the common value CV as being equal to the lowest grey level GL2 if the specific value SV1 extracted in step E2 is less than the difference GL1−GL2, then calculation of a new value SV1=GL1−GL2.

Preferably, if the maximum value encodable with the aid of the first subscans is less than the difference GL1−GL2, then the common value CV is equal to the lowest grey level GL2, and the specific value SV1 is equal to the maximum value encodable on the first subscans.

To control the error due to the use of common subscans, prior to any coding operation, the value 1 may possibly be added to and/or subtracted from one or both grey levels GL1 et GL2 so that the difference GL1−GL2 is a multiple of five.

According to a particular embodiment, the display durations associated with the first subscans correspond to the product of an elementary duration times respectively the factors: 5, 10, 20, 30, 40, 45, and the display durations associated with the second subscans correspond to the product of the elementary duration times respectively the factors: 1, 2, 4, 7, 13, 17, 25, 36.

The invention also relates to a plasma display panel comprising a plurality of cells arranged in rows and columns, each cell being lit for a duration lying between zero and a maximum display time corresponding to the maximum brightness of a cell for a given brightness setting, the total time of illumination of a cell being divided into several illumination periods corresponding to various subscans among which are distinguished first subscans specific to an addressing of each cell and second subscans common to two cells arranged on neighbouring rows, such that, for a pair of cells sharing the same second subscans, the grey levels GL1 and GL2 of the said cells are decomposed into a common value CV and into a specific value SV1 and SV2 with the aid of the following equation: GL1=CV+SV1 and GL2=CV+SV2, with GL1 greater than or equal to GL2, the said panel comprising a grey level encoding device comprising:

a first coding circuit for coding the highest grey level GL1 over the entirety of the subscans while favouring the subscans whose illumination time is the lowest;

a means for extracting a common value CV and a specific value SV1 exiting the first coding circuit;

a selection and calculation circuit for carrying out the coding of the lowest grey level by using the common value CV exiting the first coding circuit if the specific value SV1 extracted from the first coding circuit is greater than the difference GL1−GL2.

The other features of the method are also transposed over to the device.

Figure 5:
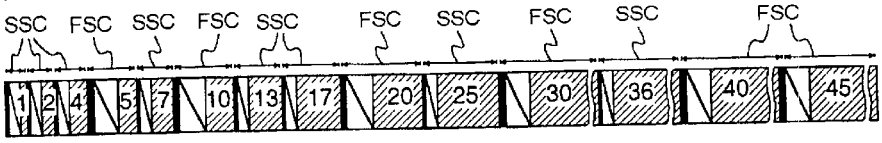
Figure 6:
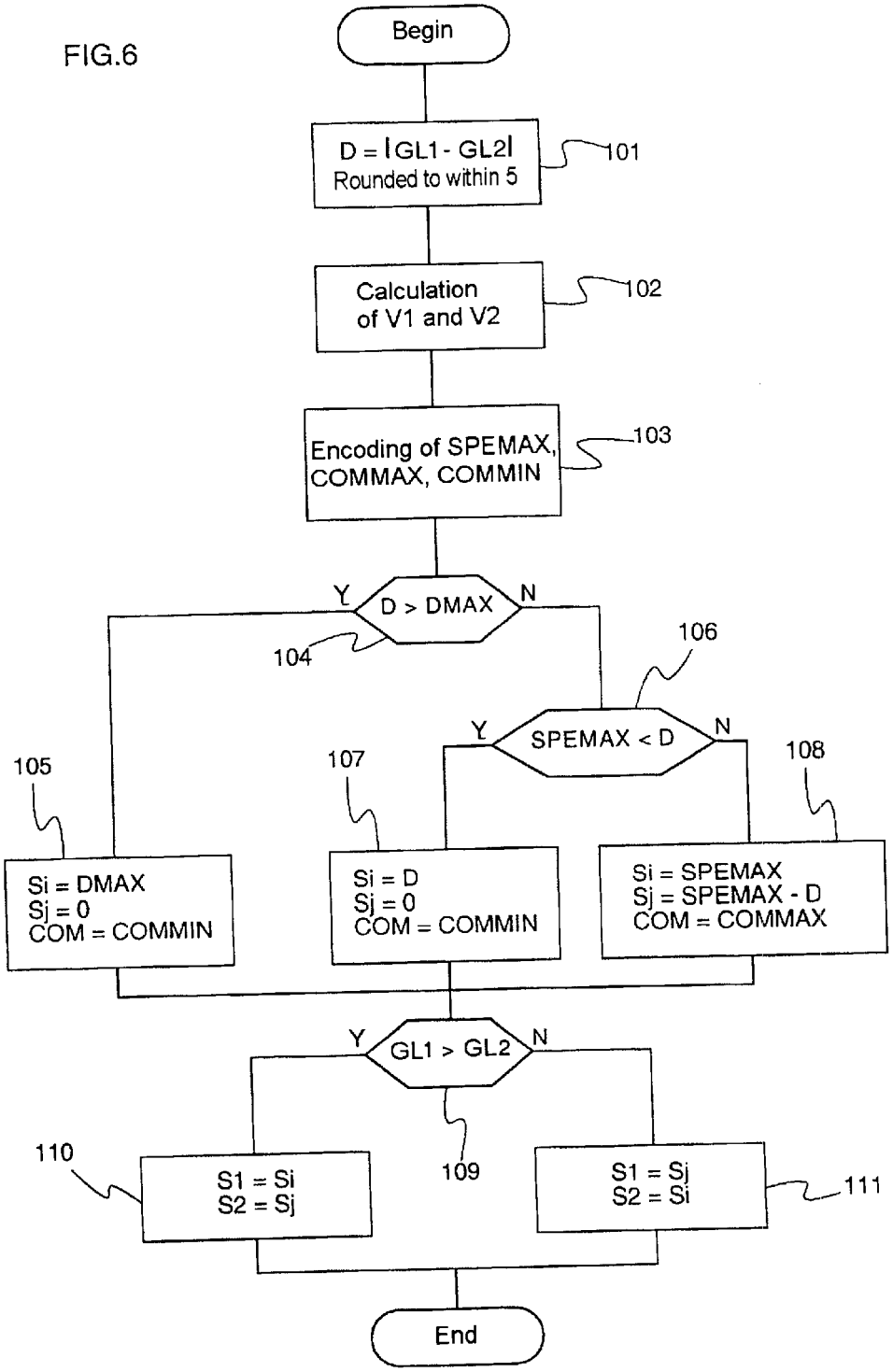
Figure 7:
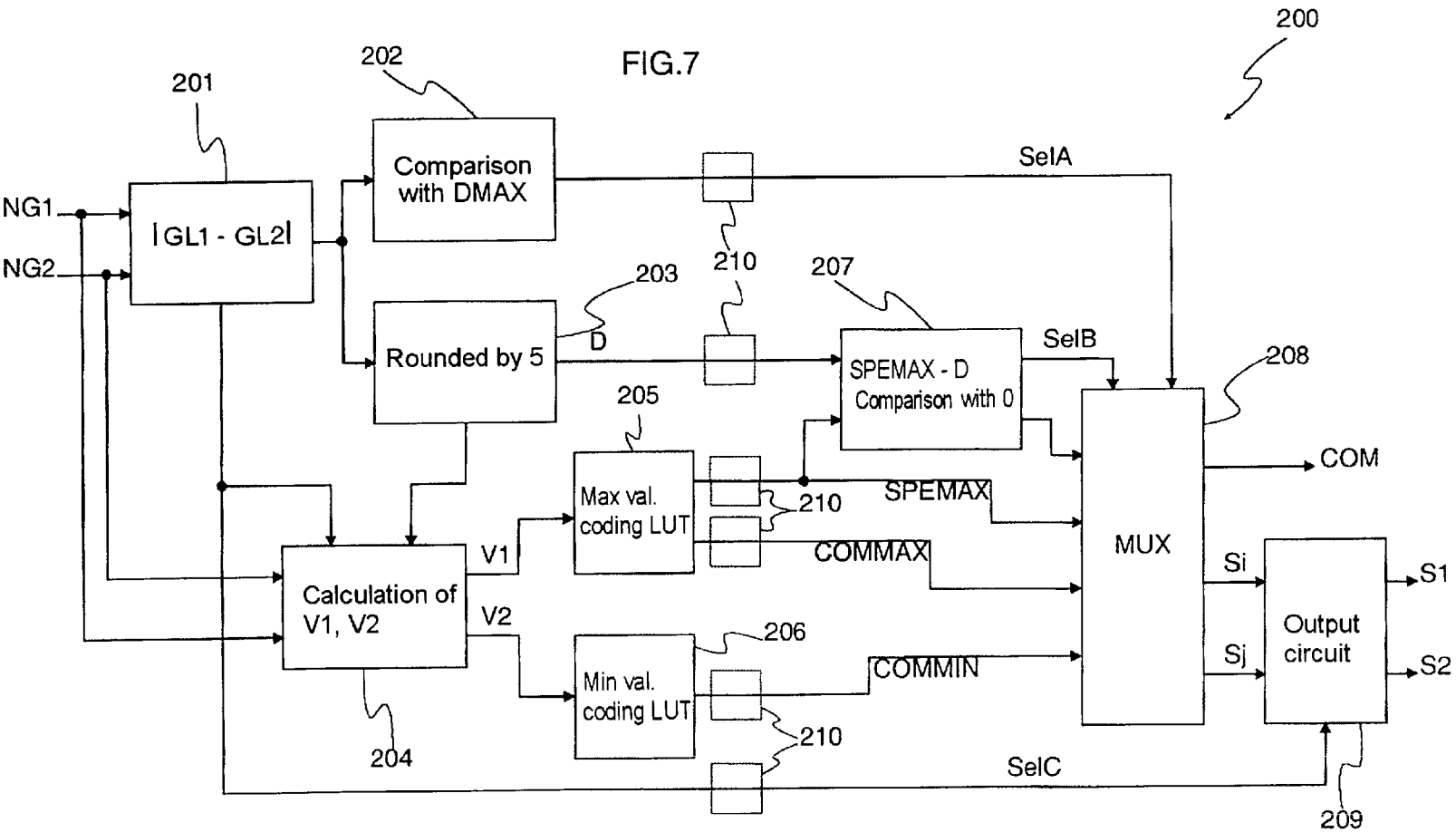
Figure 8:
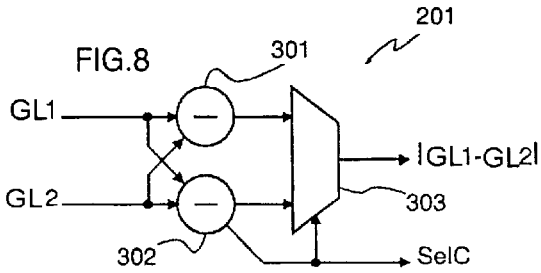
Figure 9:
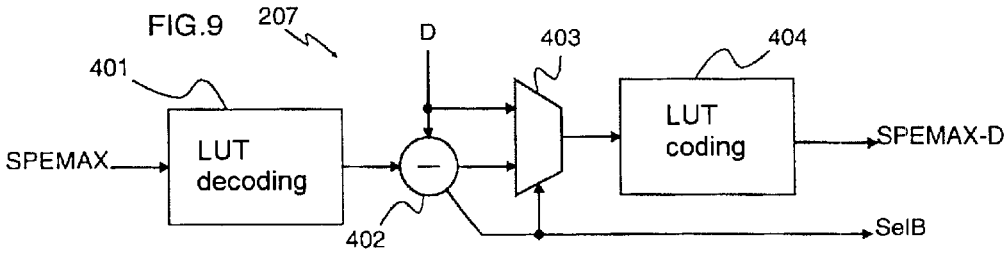
Figure 10:
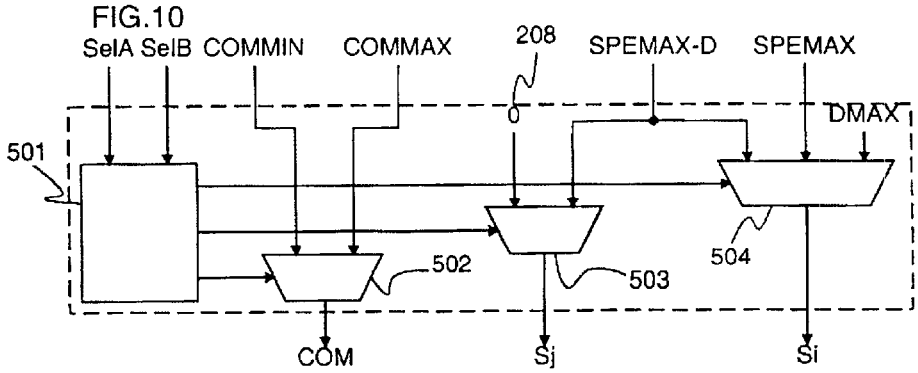
Figure 11:
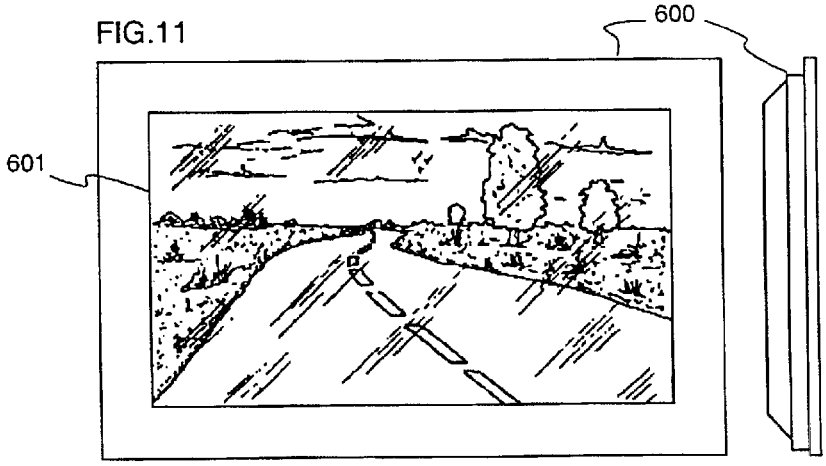

The invention will be better understood and other features and advantages will become apparent from reading the description which follows, the description making reference to the appended drawings among which:

FIGS. 1 to 4 represent temporal distributions of subscans during the displaying of an image according to the state of the art, FIG. 5 represents the temporal distribution of subscans according to a preferred embodiment, FIG. 6 represents a grey level coding algorithm according to the invention, FIG. 7 represents a processing circuit implementing the coding algorithm according to the invention, FIGS. 8 to 10 represent details of the circuit of FIG. 7, FIG. 11 represents a plasma display screen implementing the invention.

For representational reasons, the temporal distribution of the subscans uses significant proportions which do not correspond to an exact linear scale.

FIG. 5 shows a preferred temporal distribution, for which an embodiment will be described. This temporal distribution comprises first subscans FSC specific to each row, which make it possible to address each cell of the screen individually. In the preferred example, six first subscans FSC are used, with which the respective illumination weights 5, 10, 20, 30, 40 and 45 are associated. Such a choice makes it possible to have a maximum difference value of 150 over 256 grey levels. A statistical study on video images makes it possible to determine that the probability of error due to the maximum difference value is much less than 5%.

Second subscans SSC simultaneously address to adjacent rows. In the preferred example, there are eight second subscans SSC with which are associated the respective weights 1, 2, 4, 7, 13, 17, 25 and 36.

The method of coding the grey levels for each pair of cells will now be described with the aid of the algorithm of FIG. 6. The algorithm begins with two known grey levels GL1 and GL2 associated respectively with a first and a second cell.

In a first step 101, the absolute value of the difference between GL1 and GL2 is calculated. This difference |GL1−GL2| is then rounded to five to minimize the error, the rounded difference being called D herein below.

In a second step 102, the values V1 and V2 corresponding respectively to the levels GL1 and GL2 are calculated. These values V1 and V2 are determined on the one hand as a function of the rounding carried out on the difference |GL1−GL2| and on the other hand as a function of the minimum and maximum values of GL1 and GL2. In the example described, the rounding of the difference and the modifying of V1 and V2 is performed according to the following table:

| Last digit of \|GL1−GL2\| | D | V1 | V2 |
|---|---|---|---|
| 0 | 0 | Max(GL1, GL2) | Min(GL1, GL2) |
| 1 | 0 | Max(GL1, GL2) − 1 | Min(GL1, GL2) |
| 2 | 0 | Max(GL1, GL2) − 1 | Min(GL1, GL2) + 1 |
| 3 | 5 | Max(GL1, GL2) + 1 | Min(GL1, GL2) − 1 |
| 4 | 5 | Max(GL1, GL2) | Min(GL1, GL2) − 1 |
| 5 | 5 | Max(GL1, GL2) | Min(GL1, GL2) |
| 6 | 5 | Max(GL1, GL2) − 1 | Min(GL1, GL2) |
| 7 | 5 | Max(GL1, GL2) − 1 | Min(GL1, GL2) + 1 |
| 8 | 0 (diz. sup.) | Max(GL1, GL2) + 1 | Min(GL1, GL2) − 1 |
| 9 | 0 (diz. sup.) | Max(GL1, GL2) | Min(GL1, GL2) − 1 |

After calculation of the values V1 and V2 comes a third step 103 of encoding. The encoding carried out consists in performing on the one hand the coding of the value V1 over the entirety of the subscans FSC and SSC while favouring the subscans corresponding to the lowest illumination weights and on the other hand by performing the coding of the value V2 on the second subscans SSC while favouring the subscans corresponding to the low illumination weights. After encoding, a six-bit word SPEMAX is available, corresponding to the first subscans FSC used to code the value V1. The value corresponding to the sum of the weights of the first subscans activated in SPEMAX is associated with the word SPEMAX. An eight-bit word COMMAX is also available, corresponding to the second subscans SSC used to code the value VI. The value corresponding to the sum of the weights of the second subscans activated in COMMAX is associated with the word COMMAX. Finally, an eight-bit word COMMIN is available, corresponding to the second subscans SSC used to code the value V2. The value corresponding to the sum of the weights of the second subscans activated in COMMIN is associated with the word COMMIN.

On completion of the third step 103, a first test 104 is performed. The first test 104 checks that the absolute value of the rounded difference D is less than the maximum difference value DMAX, in the present example DMAX=150. The person skilled in the art will understand that this test can be carried out as soon as the first step 101 has been carried out and that it is not necessary to wait for the end of the third step 103 in order to be able to carry it out. If the first test 104 indicates D>DMAX, then the fourth step 105 is performed, otherwise, a second test 106 is performed.

The second test 106 checks whether or not the value which corresponds to SPEMAX is less than the difference D. If the value of SPEMAX is less than the difference D then a fifth step 107 is performed, otherwise a sixth step 108 is performed.

The fourth to sixth steps 105, 107 and 108 are assignment steps which determine three words Si, Sj and COM. The word Si is a six-bit word which corresponds to the coding of the first subscans FSC for the cell having the highest grey level. The word Sj is a six-bit word which corresponds to the coding of the first subscans FSC for the cell having the lowest grey level. The word COM is an eight-bit word which corresponds to the coding of the second subscans SSC which are common to both cells.

The fourth step 105 assigns the word Si so that it corresponds to the carrying out of all the first subscans FSC, the word Sj so that it corresponds to the carrying out of none of the first subscans FSC, and the word COM so that it is identical to the word COMMIN. This fourth step 104 amounts to encoding the values V1 and V2 by considering that V1=V2+DMAX. The previously mentioned case of error due to the maximum difference now holds. The combination of a maximum difference value (DMAX=150 in our example) with the coding used creates an error only in respect of the largest value which corresponds to a high luminance and hence to lesser perception for the human eye.

The fifth step 107 assigns the word Si so that it corresponds to the carrying out of the first subscans FSC whose total illumination weight corresponds to the difference D. The fifth step 107 also assigns the word Sj so that it corresponds to the carrying out of none of the first subscans FSC, and the word COM so that it is identical to the word COMMIN.

The sixth step 108 assigns the word Si so that it is identical to the word SPEMMAX, and the word COM so that it is identical to the word COMMAX. The word Sj is defined so as to correspond to an illumination corresponding to the value of the word SPEMAX minus the difference D.

On completion of the fourth to sixth steps 105, 107 and 108, a third test 109 is performed to determine which grey level GL1 or GL2 is the highest so as in seventh and eighth steps 110 and 111 to match the words Si and Sj to the words S1 and S2 which correspond to the first subscans FSC for the respective levels GL1 and GL2.

The algorithm thus described is repeated for each pair of cells whose second subscans FSC are common.

In order to better understand the manner of operation of the method forming the subject of the invention, a few exemplary applications will now be described. For greater clarity, the various words corresponding to the coding of the subscans are represented in the form of a sum of values, each value corresponding to the activation of the subscan associated with the said value.

FIRST EXAMPLE

GL1=130, GL2=124

|GL1−GL2|=6=>D=5

V1=130=1+2+5+7+10+13+17+20+25+

COMMAX=1+2+7+13+17+25

SPEMMAX=5+10+20+30

Value(SPEMMAX)=65

In this first example, the difference D is less than DMAX and D is less then SPEMAX, it is the sixth step 108 which is carried out, we will therefore have:

Si=5+10+20+30

Sj=10+20+30

COM=1+2+7+13+17+25

GL1 being greater than GL2, we obtain:

Code(GL1)=1+2+5+7+10+13+17+20+25+30

Code(GL2)=1+2+7+10+13+17+20+25+30

SECOND EXAMPLE

GL1=62, GL2=130

|GL1−GL2|=68=>D=70

V1=131=4+5+7+10+13+17+20+25+30

SPEMMAX=5+10+20+30

Value(SPEMMAX)=65

V2=61

COMMIN=2+4+13+17+25

In this second example, the difference D is less than DMAX and D is greater than SPEMAX, it is the fifth step 107 which is carried out, we will therefore have:

Si=10+20+40

Sj=0

COM=2+4+13+17+25

GL1 being less than GL2, we obtain:

Code(GL1)=2+4+13+17+25

Code(GL2)=2+4+10+13+17+20+25+40

THIRD EXAMPLE

GL1=53, GL2=242

|GL1−GL2|=189=>D=190

V=242, V2=52

COMMIN=1+4+7+13+17

In this third example, the difference D is greater than DMAX, it is the fourth step 105 which applies.

Si=5+10+20+30+40+45

Sj=0

COM=1+4+7+13+17

GL1 being less than GL2, we obtain:

Code(GL1)=1+4+7+13+17

Code(GL2)=1+4+5+7+10+13+17+20+30+40+45

In these various examples, the person skilled in the art can see that the various pairs of grey levels GL1 and GL2 share a large number of common subscans, in particular when the said levels GL1 and GL2 are very close. To this prime effect is added a grouping of the coding values of one and the same grey level. Stated otherwise, the generation of false contours due to the use of pairs is also decreased.

By way of experiment, if we take the pairs comprising on the one hand the grey level 130 and on the other hand one of the grey levels lying between 0 and 255, the person skilled in the art can appreciate that in 75% of cases the coding of the level 130 is performed on the twelve subscans of low weight. Although the level 130 is coded according to sixteen different codes, the distribution of subscans remains grouped and homogeneous, thereby eliminating any false contour effect.

In 22% of possible cases, one of the two subscans of high weight is used to code the value 130. However, the various codings exhibit homogeneous distributions over the eleven subscans of low weight which minimize the false contour effect.

The cases corresponding to the most detrimental coding, that is to say to the simultaneous use of the two subscans of high weight, correspond to 7% of the possible combinations.

Another factor decreasing the awareness by the human eye of this coding defect stems from the fact that the pairs giving rise to such a defect correspond to a strong transition which attenuates the false contour effect.

A preferred embodiment of the invention will now be described while referring to FIGS. 7 to 10. FIG. 7 represents an encoding device 200, according to the invention, serving to code the grey levels as a drive code for the various subscans FSC and SSC. A plasma display panel can comprise one or more devices of this type depending on the necessary calculation time and the number of cells present on the said panel.

The encoding device 200 deploys first and second input buses, for example eight-bit busses, for receiving the grey levels GL1 and GL2 corresponding to two cells sharing the same second subscans SSC. The grey levels GL1 and GL2 may originate either from an image memory containing the entire image, or from a decoding device which performs the decoding of a video signal and which translates it into a grey level for each cell. The encoding device 200 deploys three output buses which supply the words COM, Si and S2 which correspond respectively to ignition or nonignition codes for the second subscans SSC, for the first subscans FSC associated with the first grey level GL1 and for the first subscans associated with the second grey level GL2.

The encoding device 200 comprises a difference circuit 201 which receives the two grey levels GL1 and GL2 to be encoded and supplies on a first output the absolute value of the difference between GL1 and GL2. Moreover, on a second output of the said difference circuit 201, an information bit SeIC indicates which grey level GL1 or GL2 is to be regarded as greater than the other.

The difference circuit 201 is for example constructed as indicated in FIG. 8. First and second subtraction circuits 301 and 302 receive the grey levels GL1 and GL2 on opposite inputs, so that the first subtraction circuit 301 supplies on a result output the difference GL1−GL2 and so that the second subtraction circuit 302 supplies on a result output the difference GL2−GL1. The second subtraction circuit furthermore deploys an overflow output (also known as a carry output) which makes it possible to ascertain whether the result of the subtraction is positive or negative and hence supplies the information bit SelC. A multiplexer 303 receives the information bit SelC on a selection input and deploys first and second inputs connected to the result outputs of the first and second subtraction circuits 301 and 302 respectively. The multiplexer 303 selects the positive result as a function of the information bit SelC so that the output of the multiplexer 303 corresponds to the output of the difference circuit 201.

The encoding device 200 furthermore comprises a first comparison circuit 202 which compares the absolute value of the difference |GL1−GL2| with the maximum difference value DMAX which is fixed by the subscans used. The first comparison circuit 202 supplies a first selection signal SelA which corresponds to the result of the first test 104. The person skilled in the art may note that it is not necessary to round up to 5 in order to perform this comparison since the final result remains equivalent before or after rounding.

A rounding circuit 203 receives the absolute value of the difference |GL1−GL2| so as to round it to 5. A first output supplies the rounded difference D and a second output supplies a rounding control bus. The rounding control bus indicates the manner in which the values V1 and V2 are to be modified. The rounding circuit 203 can be embodied with the aid of a lookup table, some of the output bits of which correspond to the rounded difference D and some of the output bits of which correspond to a control code.

A calculation circuit 204 receives the grey levels GL1 and GL2 and supplies the values V1 and V2 which will be used for the coding. For this purpose, the calculation circuit 204 receives the information bit SeIC so as to match the highest level GL1 or GL2 with the value V1 and the lowest level GL1 with the value V2. The calculation circuit 204 also receives the control bus originating from the rounding circuit 203 so as, if necessary, to carry out an addition or a subtraction of one unit on V1 and/or V2.

A first coding circuit 205 receives the value V1 and supplies a complete coding of this value on the entirety of the subscans FSC and SSC. However, a six-bit bus supports the word SPEMAX corresponding to the first subscans FSC and an eight-bit bus supports the word COMMAX corresponding to the second subscans SSC. For the sake of simplicity and speed of calculation, a lookup table which contains an optimum coding is used.

A second coding circuit 206 receives the value V2 and supplies a coding of this value on the second subscans SSC only. The output bus of this second coding circuit 206 supports the word COMMIN. This second coding circuit can also be embodied with the aid of a lookup table. The person skilled in the art will note that only a limited number of different values actually need to be coded and that it is therefore not necessary to use a table deploying more than seven input bits.

A second comparison circuit 207 receives on this one hand the rounded difference D and on the other hand the word SPEMAX. This second comparison circuit will compare the value associated with the word SPEMAX with the rounded difference D so as to supply on a first output a second selection signal SeIB which corresponds to the result of the second test 106. The second comparison also supplies on a second output a six-bit word corresponding to the first subscans and having an associated illumination which corresponds either to the rounded difference D or to the illumination associated with SPEMAX from which the rounded difference D has been deducted.

An exemplary embodiment of the second comparison circuit 207 is represented in FIG. 9. The second comparison circuit 207 comprises a decoding circuit 401, a subtraction circuit 402, a multiplexer 403 and a coding circuit 404. The decoding circuit 401 is for example a lookup table receiving the six bits of the word SPEMAX and supplying an eight-bit word corresponding to the value representative of the illumination associated with the word SPEMAX. The subtraction circuit 402 deploys two inputs respectively receiving the rounded difference D and the word exiting the decoding circuit 401, so that it supplies on its output the result of the difference corresponding to the value of SPEMAX−D. The subtraction circuit 402 deploys an overflow output or carry output which indicates whether the result of the subtraction is positive or negative. The said overflow output thus supplies the second selection signal SelB. The multiplexer 403 deploys two input buses respectively receiving D and the result exiting the subtraction circuit 402. A selection input of the multiplexer 403 receives the second selection signal so that the output bus of the multiplexer 403 supplies D if D is greater than the value of SPEMAX or the result exiting the subtraction circuit 402 otherwise. The coding circuit is a lookup table which deploys an input connected to the output of the multiplexer 403 so as to receive, either D, or SPEMAX−D, in order to supply a six-bit code corresponding to the coding of the input value with the aid of the first subscans FSC.

The encoding device 200 comprises a selection circuit 208 which receives on the one hand the various words COMMIN, COMMAX, SPEMAX and the word exiting the second comparison circuit, and on the other hand the first and second selection signals SelA and SelB. The said selection circuit supplies, on first and second outputs, first and second words Si and Sj of six bits corresponding to the codings of the first subscans for the two grey levels GL1, GL2, and, on a third output, a third word COM of eight bits corresponding to the common coding of the second subscans for the two grey levels GL1 and GL2

An exemplary embodiment of the selection circuit 208 is shown in FIG. 10. The circuit 208 comprises a decoder 501 and three multiplexers 502 to 503. The decoder circuit 401 receives the first and second selection signals SelA and SelB and supplies the controls necessary for the three multiplexers 502 to 504 in order to perform the branchings defined in the fourth to sixth steps 105, 107 and 108.

The multiplexer 502 deploys two inputs which receive the words COMMIN and COMMAX and an output which supplies the word COM. The word COM corresponds, either to COMMIN when the first selection signal SelA indicates that D is greater than DMAX or when the second selection signal SelB indicates that the value of SPEMAX is less than D, or corresponds to COMMAX when the first and second signals indicate that D is not greater than DMAX and that the value of SPEMAX is not less than D.

The multiplexer 503 deploys two inputs and one output. One of the said inputs receives the six-bit word originating from the second comparison circuit 207, the other of the said inputs receives a six-bit word corresponding to the zero value encoded for the first subscans, and the output supplies the word Sj. The word Sj corresponds, either to the zero value coded on six bits when the first selection signal SelA indicates that D is greater than DMAX or when the second selection signal SelB indicates that the value of SPEMAX is less than D, or corresponds to the word exiting the second comparison circuit 207 COMMAX when the first and second signals SelA and SelB indicate that D is not greater than DMAX and that the value of SPEMAX is not less than D.

The multiplexer 504 deploys first to third inputs and an output. The first input receives a word corresponding to DMAX, that is to say corresponding to the maximum illumination possible with the aid of the first subscans FSC. The second input receives the word SPEMAX. The third input receives the word exiting the second comparison circuit 207. The output supplies the word Si which corresponds, either to the word corresponding to DMAX when the first signal SelA indicates that D is greater. than DMAX, or SPEMAX when the first and second signals SelA and SelB indicate that D is not greater than DMAX and that SPEMAX is not less than D, or the word exiting the second comparison circuit when the signals SelA and SelB indicate that D is not greater than DMAX and that SPEMAX is less than D.

The encoding device 200 comprises an output circuit 209 which receives the words Si and Sj so as to match them either respectively to the words S1 and S2, or respectively to the words S2 and S1 as a function of the information bit SelC.

The encoding device 200 is then incorporated into a display panel 600 so as to allow image display 601, as represented in FIG. 11.

Such an encoding device 200 can be embodied according to different variants. By way of example, if the person skilled in the art deems the calculation time to be too small, it is for example possible to adopt a pipeline type structure. Accordingly, it is for example possible to add extra storage registers 210 as indicated in FIG. 7 so as to perform the calculation in two stages, thereby allowing an overall reduction in the calculation time for an image.

Numerous other alternatives are available to the person skilled in the art. In the preferred example, lookup tables are used to perform the codings and decodings for reasons of simplicity of implementation and hence of reliability. It goes without saying that these lookup tables can be replaced by calculation circuits, in particular if it is chosen to implement such a device with the aid of microcontroller type circuits.

More generally, the person skilled in the art may also elect to carry out the method of the invention solely with the aid of programmed circuits essentially comprising a processor and a memory. The device thus embodied will deploy a totally different structure from the device represented.

Also, in the present description of the invention, reference is made to a coding using six first subscans whose respective weights are 5, 10, 20, 30, 40 and 45 and eight second subscans whose respective weights are 1, 2, 4, 7, 13, 17, 25 and 36. This coding has been chosen for the present description since it enables good results to be obtained. No reference has been made to other types of coding during the description for reasons of clarity, but it is obvious that other types of coding may be used with the same method provided that certain numerical values are changed.

By way of complementary example, it is for example possible to use a coding for sixteen subscans comprising four first subscans whose respective weights are 5, 10, 20 and 35 and ten second subscans whose respective weights are 1, 2, 4, 6, 9, 12, 15, 19, 23, 27, 31 and 36, taking care to modify accordingly the various quantities (value of DMAX, number of coding bits) which have been used in the description.

What is claimed is:

1. Method of displaying a video image on a plasma display panel for a duration of display, the said panel comprising a plurality of cells arranged in rows and columns, each cell being lit for a duration lying between zero and a maximum display time corresponding to the maximum brightness of a cell for a given brightness setting, the total time of illumination of a cell being divided into several illumination periods corresponding to various subscans among which are distinguished first subscans specific to an addressing of each cell and second subscans common to two cells arranged on neighbouring rows, such that, for a pair of cells sharing the same second subscans, the grey levels GL1 and GL2 of the said cells are decomposed into a common value CV and into a specific value SV1 and SV2 with the aid of the following equation: GL1=CV+SV1 and GL2=CV+SV2, with GL1 greater than or equal to GL2, the common value CV corresponding to the sum of the weights of the second subscans, the specific values SV1 and SV2 corresponding to the sum of the weights of the first subscans associated respectively with the grey levels GL1 and GL2, wherein the following steps are carried out:

E1: coding of the highest grey level GL1 over the entirety of the subscans while favouring the subscans whose illumination time is the smallest;

E2: extraction of a specific coding value corresponding to the sum of the first subscans used during the coding of step E1;

E3: if the specific coding value extracted in step E2 is less than the difference GL1−GL2, then the values SV1 and CV correspond to the coding carried out in step E1, and the resulting value SV2 equal to GL2−CV is coded on the second subscans while favouring the subscans of low weight.

2. Method according to claim 1, wherein the following step is carried out:

E4: if the specific coding value extracted in step E2 is less than the difference GL−GL2, then the common value CV is equal to the lowest grey level GL2 and then a new value SV1=GL1−GL2 is calculated.

3. Method according to claim 1, wherein, if the maximum value encodable with the aid of the first subscans is less than the difference GL1−GL2, then the common value CV is equal to the lowest grey level GL2, and the specific value SV1 is equal to the maximum value encodable on the first subscans.

4. Method according to claim 1, wherein prior to any coding operation, the value 1 may possibly be added to and/or subtracted from one or both grey levels GL1 et GL2 so that the difference GL1−GL2 is a multiple of five.

5. Method according to claim 1, wherein the display durations associated with the first subscans correspond to the product of an elementary duration times respectively the factors: 5, 10, 20, 30, 40, 45, and in that the display durations associated with the second subscans correspond to the product of the elementary duration times respectively the factors: 1, 2, 4, 7, 13, 17, 25, 36.

6. Plasma display panel comprising a plurality of cells arranged in rows and columns, each cell being lit for a duration lying between zero and a maximum display time corresponding to the maximum brightness of a cell for a given brightness setting, the total time of illumination of a cell being divided into several illumination periods corresponding to various subscans among which are distinguished first subscans specific to an addressing of each cell and second subscans common to two cells arranged on neighbouring rows, such that, for a pair of cells sharing the same second subscans, the grey levels GL1 and GL2 of the said cells are decomposed into a common value CV and into a specific value SV1 and SV2 with the aid of the following equation: GL1=CV+SV1 and GL2=CV+SV2, with GL1 greater than or equal to GL2, the common value CV corresponding to the sum of the weights of the second subscans, the specific values SV1 and SV2 corresponding to the sum of the weights of the first subscans associated respectively with the grey levels GL1 and GL2, wherein it comprises a grey level encoding device comprising:

a first coding circuit for coding the highest grey level GL1 over the entirety of the subscans while favouring the subscans whose illumination time is the lowest;

a means for extracting a specific coding value exiting the first coding circuit;

a selection and calculation circuit for carrying out the coding of the lowest grey level by using the common value CV exiting the first coding circuit if the specific coding value extracted from the first coding circuit is greater than the difference GL1−GL2.

7. Panel according to claim 6, wherein it comprises a second coding circuit for coding the common value CV as being equal to the lowest grey level GL2, and in that, if the specific coding value extracted from the first coding circuit is less than the difference GL1−GL2, the selection and calculation circuit determines a new value SV1=GL1−GL2.

8. Panel according to claim 6, wherein it comprises a comparison circuit for comparing the difference GL1−GL2 with a maximum value encodable on the first subscans, and in that the selection and calculation circuit determines that SV1 is equal to the maximum value encodable on the first subscans and that the common value is equal to the lowest grey level.

9. Panel according to claim 6, wherein it comprises a rounding circuit placed upstream of the first and second coding circuits, the said rounding circuit possibly adding the value 1 to or subtracting the value 1 from one or both grey levels GL1 and GL2 so that the difference GL1−GL2 is a multiple of five.

* * * * *